US006926076B2

(12) United States Patent
Blomgren

(10) Patent No.: US 6,926,076 B2
(45) Date of Patent: Aug. 9, 2005

(54) PLATE HEAT EXCHANGER

(75) Inventor: Ralf Blomgren, Skanör (SE)

(73) Assignee: Alfa Laval Corporation AB, Lund (SE)

( * ) Notice: Subject to any disclaimer, the term of this patent is extended or adjusted under 35 U.S.C. 154(b) by 0 days.

(21) Appl. No.: 10/795,678

(22) Filed: Mar. 8, 2004

(65) Prior Publication Data

US 2004/0168793 A1 Sep. 2, 2004

Related U.S. Application Data

(63) Continuation of application No. 09/395,121, filed on Sep. 14, 1999, now Pat. No. 6,702,005, which is a continuation of application No. 08/313,262, filed on Sep. 29, 1994, now abandoned, which is a continuation of application No. PCT/SE94/00040, filed on Jan. 20, 1994.

(30) Foreign Application Priority Data

Feb. 19, 1993 (SE) ..... 9300570

(51) Int. Cl.[7] ..... F28F 3/00
(52) U.S. Cl. ..... 165/167; 165/166
(58) Field of Search ..... 165/166, 167

(56) References Cited

U.S. PATENT DOCUMENTS

| | | | |
|---|---|---|---|
| 2,610,835 | A | 9/1952 | Hytte |
| 2,937,856 | A | 5/1960 | Thomson |
| 4,176,713 | A | 12/1979 | Fisher |
| 4,307,779 | A | 12/1981 | Johansson et al. |
| 4,434,643 | A | 3/1984 | Almqvist et al. |
| 4,635,714 | A | 1/1987 | Almqvist et al. |
| 4,781,248 | A | 11/1988 | Pfeiffer |
| 4,911,235 | A | 3/1990 | Andersson et al. |
| 5,174,370 | A | 12/1992 | Hallgren |
| 5,193,612 | A | 3/1993 | Stirnkorb |
| 6,702,005 | B1 * | 3/2004 | Blomgren ..... 165/166 |

FOREIGN PATENT DOCUMENTS

| | | |
|---|---|---|
| DE | 844600 | 5/1952 |
| DE | 4020735 C2 | 11/1992 |
| GB | 521285 | 5/1940 |
| GB | 1339542 | 12/1973 |
| GB | 1468514 | 3/1977 |
| JP | 4-139388 | 5/1992 |
| NO | 75721 | 2/1943 |
| SE | 466171 | 1/1992 |
| WO | 88/01722 | 3/1988 |

* cited by examiner

*Primary Examiner*—Leonard R. Leo
(74) *Attorney, Agent, or Firm*—Fish & Richardson P.C.

(57) ABSTRACT

The present invention is a plate heat exchanger for heat transfer between two fluids, having several thin heat transfer plates (1) abutting towards each other and between the heat transfer plates (1) arranged sealing members (6), which in alternate plate interspaces delimit a flow space for a first fluid and in the remaining plate interspaces delimit flow spaces for a second fluid, each heat transfer plate (1) having a pressed corrugation pattern, which has two distribution portions (7, 8) and, arranged between these, a main heat transfer portion (9), which is divided in several areas **(10*a*, 10*b*) with parallel ridges and valleys, and the plate heat exchanger having inlets and outlets for the fluids, arranged such that the fluids will have a flow direction between the heat transfer plates (1) essentially from one to the other of the distribution portions (7,8) at each heat transfer plate. According to the invention the heat transfer portion (9) of each heat transfer plate (1) has a row with at least three areas (10*a*, 10*b*) located after each other in the flow direction and an even number of such rows are arranged next to each other across the flow direction, by which the parallel ridges and valleys of each pair of adjacent areas (10*a*, 10*b*) extend in such a way that they form mirror images of each other with reference to an imaginary line between respective areas (10*a*, 10*b*)**.

2 Claims, 1 Drawing Sheet

PLATE HEAT EXCHANGER

Figure 1:
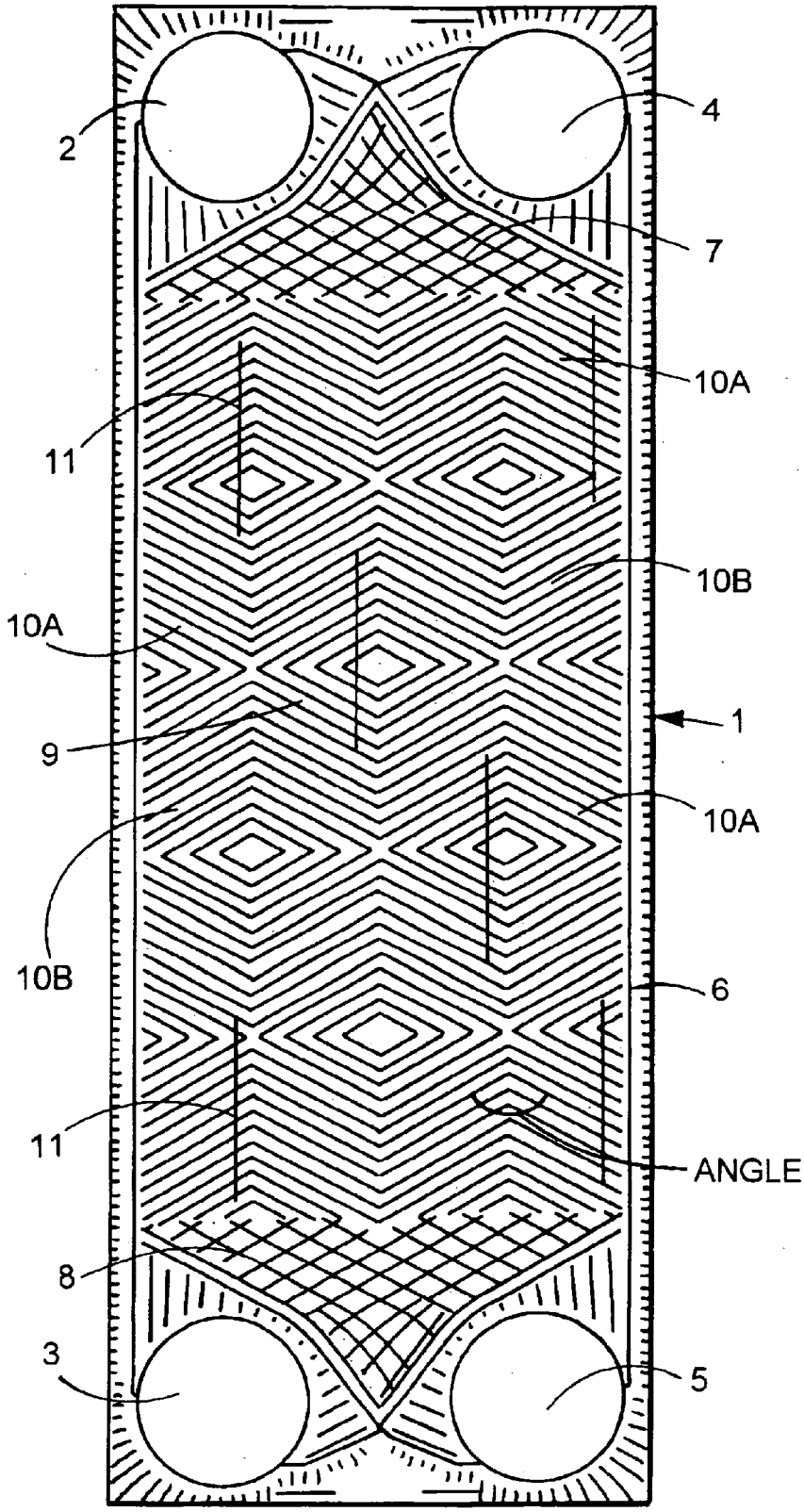

This application is a continuation of U.S. Ser. No. 09/395,121, filed Sep. 14, 1999 now U.S. Pat. No. 6,702,005, which is a continuation of U.S. Ser. No. 08/313,262, filed Sep. 29, 1994 (abandoned), which is the U.S. national phase application of International Application PCT/SE94/00040, filed Jan. 20, 1994, and claims the benefit of Swedish Application No. 9300570-0, filed Feb. 19, 1993.

The present invention refers to a plate heat exchanger for heat transfer between two fluids, comprising several abutting thin heat transfer plates and arranged between the heat transfer plates sealing members, which in alternate plate interspaces delimit a flow space for a first fluid and in the remaining plate interspaces delimit flow spaces for a second fluid, each heat transfer plate having a pressed corrugation pattern, which has two distribution portions and, arranged between said distribution portions, a main heat transfer portion, which is divided into several areas with parallel ridges and valleys, the plate heat exchanger having inlets and outlets for said fluids, arranged in such a way that the fluids will have a flow direction, between the heat transfer plates, essentially from one to the other of the distribution portions of each heat transfer plate.

From GB 1468514 a plate heat exchanger for heat transfer between two fluids is previously known, which is assembled from several heat transfer plates arranged such that the fluids flow on both sides of the plates. The heat transfer plates have a pressed corrugation pattern with an upper distribution portion and a lower distribution portion and, arranged between the distribution portions, a main heat transfer portion. The heat transfer portion comprises a pressed corrugation pattern with parallel ridges and valleys and is formed with several band like areas, extending along the plates. Between the heat transfer plates sealing members are arranged, which in alternate plate interspaces delimit a flow space for a first fluid and in the remaining plate interspaces delimit flow spaces for a second fluid.

From GB 1339542 a plate heat exchanger for heat transfer between two fluids is previously known, which is assembled from several heat transfer plates so arranged that fluids flow on each side of the plates. The heat transfer plates show two distribution portions and, arranged between the distribution portions, a main heat transfer portion. The heat transfer portion comprises a pressed corrugation pattern with parallel ridges and valleys and is formed with several band like areas, extending across the plates.

Despite the fact that the previously known plate heat exchangers show heat transfer portions formed with several areas, which extend across or along the plates, a problem occurs in that the plates are deformed. I.e. the plates bend or bulge in different directions. Thus, the plates become difficult to handle, e.g. during mounting on a conventional carrying bar or during welding of the plates.

The problem stems from the fact that a strong corrugation of the heat transfer portion of the plates admits an elongation of the plates in said portion. This problem occurs especially when the parallel ridges and valleys have a small angle compared to an imaginary axis around which the plate may have a risk of being curved, simultaneously as the remaining parts of the plate, e.g. sealing grooves or portions of the ports, cannot give sufficient rigidity to restrain the deformation.

The object of the present invention is, in a plate heat exchanger of the kind described, to achieve a heat transfer plate in which the corrugation pattern is so shaped that the risk of deformation decreases so that handling of the heat transfer plates is enhanced compared with previously known heat transfer plates.

According to the invention these objects are achieved by a plate heat exchanger of the introductory kind described, which is characterized in that the heat transfer portion of each heat transfer plate comprises a row with a least three areas, located following one another in said flow direction, that an even number of such rows are arranged adjacent to each other across the flow direction, and that the parallel ridges and valleys of each pair of adjacent areas extend in such a way, that they form mirror images of each other with reference to an imaginary line between respective areas.

The invention is also applicable for other types of plate heat exchangers and refers also to a heat transfer plate for a plate heat exchanger, comprising inlets and outlets, for at least two heat transfer fluids and, arranged between the outlets, a heat transfer portion, the inlets and the outlets being arranged so that said fluids will have a flow direction essentially from respective inlet to respective outlet, the heat transfer portion being provided with a pressed corrugation pattern which is divided into several areas having parallel ridges and valleys, characterized in that the heat transfer portion comprises a row with at least three areas located after each other in said flow direction, and that an even number of such rows is arranged next to each other across the flow direction, and that the parallel ridges and valleys of each pair of adjacent areas extend in such a way that they form mirror images of each other with reference to an imaginary line between respective areas.

The invention will be described closer in the following with reference to the enclosed drawing, in which FIG. 1 shows a front view of a heat transfer plate formed according to the invention.

The present plate heat exchanger is intended to transfer heat between two media, preferably fluids, and is assembled of several abutting thin, mainly rectangular elongated heat transfer plates. Other shapes of the heat transfer plates, such as round shapes, could be possible.

In FIG. 1 a heat transfer plate 1 is shown, formed according to the invention, which conventionally is provided with an inlet port 2 and an outlet port 3, for a first heat transfer fluid, and an inlet port 4 and an outlet port 5, for a second heat transfer fluid. A sealing member 6 extends around the ports 4 and 5 and around the periphery of the plate, the sealing member 6 together with an additional heat transfer plate delimiting a flow space for one of said heat transfer fluids and passages for through flow of the other heat transfer fluid. The sealing member 6 may be made of a gasket located in a gasket groove, but also other known sealing arrangements could be used, such as welding, brazing or glueing.

The heat transfer plate 1 by pressing has been provided with a corrugation pattern and has between the inlet ports 2 and 4, respectively, and the outlet ports 3 and 5, respectively, two distribution portions 7 and 8 and a main heat transfer portion 9 located between the distribution portions, which latter portion is divided into several areas 10*a* and 10*b*, each area comprising several parallel ridges and valleys.

In a plate heat exchanger according to the invention several identical heat transfer plates 1 are assembled to form a package, in which one of two adjacent heat transfer plates is rotated 180° in its own plane relative to the other. By this means, the ridges in said areas 10*a* on one of the heat transfer plates 1 will abut the ridges, which are produced by the valleys, in said area 10*b* on the second heat transfer plate. Naturally, the plate heat exchanger may also consist of two different kinds of heat transfer plates stapled to each other.

The plate heat exchanger thus has inlets and outlets arranged such that a heat transfer fluid will have a flow direction between the heat transfer plates 1, extending essentially from one distribution portion 7 to the other distribution portion 8 of each heat transfer plate 1. In this case the flow direction is essentially parallel with the long sides of the heat transfer plates. Alternate plate interspaces of the plate heat exchanger delimit flow spaces for a first fluid and the remaining plate interspaces delimit flow spaces for a second fluid.

The heat transfer portion 9 of each heat transfer plate 1 comprises a row with at least three areas 10*a* and 10*b* located after each other in said flow direction, and an even number of such rows are arranged next to each other across the flow direction. By this arrangement, the parallel ridges and valleys at each pair of adjacent areas 10*a* and 10*b* will extend in such way that they form mirror images of each other with reference to an imaginary line between them. Consequently, the parallel ridges and valleys of two diagonally located areas (either 10*a* or 10*b*) will be identical.

By splitting the heat transfer portion 9 into several smaller areas 10*a* and 10*b*, in which the adjacent areas form mirror images, four such areas will effectively act against one another's tendency of elongating themselves and by that stiffen the heat transfer plate in its plane, i.e. a lengthening of an area 10*a*, through a flattening of its ridges and valleys, in a direction perpendicular to the ridges and the valleys, is prohibited by adjacent areas 10*b*, whose ridges and valleys will not admit elongating in said direction. The diagonally located areas will form a kind of framework that counteracts the elongation of the heat transfer plate.

Preferably, the heat transfer portion 9 of each heat transfer plate 1 comprises rows with an odd number of areas 10*a* and 10*b* located after one another in the flow direction, by which expedient it is possible to form a plate heat exchanger of only one kind of plates.

Most of the known heat transfer plates could be formed with a heat transfer portion having several areas in accordance with invention, but the most tangible effect of the proposed dividing of the heat transfer portion is obtained in huge heat transfer plates; mainly, long plates intended for small flow, i.e. in which the parallel ridges and valleys of each pair of adjacent areas 10*a* and 10*b* extend with an intermediate angle, which is obtuse in relation to the flow direction, a so-called high-θ plate.

To further prohibit prolonging of the heat transfer plate the heat transfer portion may be provided with-upwards pressed reinforcement grooves 11, extending in the flow direction along one or several areas. In order that these reinforcing grooves shall not form bypass ducts for the heat transfer fluid, they should not extend along the entire length of the heat transfer portion or a major part thereof. Instead, the reinforcing grooves may be displaced relative to each other, so that they overlap the entire length of the heat transfer portion, but they should not coincide with each other when two heat transfer plates are arranged towards each other.

What is claimed is:

1. A heat transfer plate for heat transfer between two fluids having a pressed corrugation pattern, said plate having first and second distribution portions and, arranged between said distribution portions, a main heat transfer portion, said main heat transfer portion being divided into several areas having parallel ridges and valleys, the first and second distribution portions having inlets and outlets for said fluids, arranged in such a way that the fluids will have a flow direction essentially from one to the other of the distribution portions of the heat transfer plate, wherein the main heat transfer portion of each heat transfer plate comprises a row with an odd number of at least three areas located following one another in said flow direction, an even number of such rows are arranged next to each other across the flow direction, at least said three areas of each row being situated beside corresponding areas of an adjacent row, the parallel ridges and valleys of each pair of adjacent areas, both in said flow direction and across said flow direction, extend in such a way, that they form mirror images of each other with reference to an imaginary line between respective areas, and the main heat transfer portion is provided with upwardly pressed reinforcing grooves, extending in the flow direction and staggered in the flow direction relative to each other.

2. A heat transfer plate according to claim 1, wherein each reinforcing groove extends only over a part of the main heat transfer portion.

* * * * *

UNITED STATES PATENT AND TRADEMARK OFFICE

CERTIFICATE OF CORRECTION

PATENT NO. : 6,926,076 B2
DATED : August 9, 2005
INVENTOR(S) : Ralf Blomgren

It is certified that error appears in the above-identified patent and that said Letters Patent is hereby corrected as shown below:

Title page,
Item [73], Assignee, change from "Alfa Laval Corporation AB" to -- Alfa Laval Corporate AB --.

Signed and Sealed this

Eleventh Day of October, 2005

JON W. DUDAS
*Director of the United States Patent and Trademark Office*